US009914280B2

(12) United States Patent
Takashima et al.

(10) Patent No.: US 9,914,280 B2
(45) Date of Patent: Mar. 13, 2018

(54) BINDING DEVICE AND IMAGE FORMING APPARATUS INCLUDING THE SAME

(71) Applicants: Ikumi Takashima, Kanagawa (JP); Akihiro Tsuno, Kanagawa (JP); Hirotaka Hayashi, Kanagawa (JP)

(72) Inventors: Ikumi Takashima, Kanagawa (JP); Akihiro Tsuno, Kanagawa (JP); Hirotaka Hayashi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 265 days.

(21) Appl. No.: 14/810,904

(22) Filed: Jul. 28, 2015

(65) Prior Publication Data

US 2016/0041516 A1 Feb. 11, 2016

(30) Foreign Application Priority Data

Aug. 11, 2014 (JP) ..... 2014-163277

(51) Int. Cl.
*B31F 1/07* (2006.01)
*G03G 15/00* (2006.01)
(Continued)

(52) U.S. Cl.
CPC ..... *B31F 1/07* (2013.01); *B31F 5/022* (2013.01); *B65H 37/04* (2013.01);
(Continued)

(58) Field of Classification Search
CPC ..... G03G 15/6541; G03G 2215/00852; B65H 37/04; B65H 2301/51616;
(Continued)

(56) References Cited

U.S. PATENT DOCUMENTS 4,207,143 A * 6/1980 Glomb ..... D21G 7/00 162/207
6,077,590 A * 6/2000 Archer ..... B31F 1/07 162/109

(Continued)

FOREIGN PATENT DOCUMENTS

| | | | |
|---|---|---|---|
| GB | 2515559 | A * | 12/2014 |
| JP | 2009051661 | A * | 3/2009 |
| JP | 5253453 | | 4/2013 |
| JP | 2013-180883 | | 9/2013 |

OTHER PUBLICATIONS

Machine translation of JP 2009-051661 A by Japan Platform for Patent Information.*

*Primary Examiner* — Leslie A Nicholson, III
(74) *Attorney, Agent, or Firm* — Harness, Dickey & Pierce, P.L.C.

(57) ABSTRACT

According to an aspect of the invention, a binding device includes a first rotary member including a first serrated portion on its circumferential surface, a second rotary member including, on its circumferential surface, a second serrated portion to be engaged with the first serrated portion at an engaging position and configured to perform a binding process by rotating together with the first rotary member with a bundle of sheets pinched therebetween to form serrations in the sheet bundle in thickness direction and bring the sheets into engagement with each other while relatively moving the sheet bundle in a predetermined moving direction, and a clamping unit configured to, when the binding process is performed, clamp the sheet bundle at a clamping position upstream of the engaging position to apply a predetermined pulling force acting in a direction opposite to the moving direction to the sheet bundle.

17 Claims, 5 Drawing Sheets

(51) Int. Cl.
*B65H 37/04* (2006.01)
*B31F 5/02* (2006.01)

(52) U.S. Cl.
CPC .. *G03G 15/6541* (2013.01); *B31F 2201/0715* (2013.01); *B31F 2201/0743* (2013.01); *B65H 2301/43828* (2013.01); *B65H 2301/51616* (2013.01); *G03G 2215/00822* (2013.01)

(58) Field of Classification Search
CPC ..... B65H 2301/53828; B31F 5/022; B31F 2201/0743; B31F 2201/0715
USPC ..... 270/58.07, 58.08
See application file for complete search history.

(56) References Cited

U.S. PATENT DOCUMENTS

| | | | | |
|---|---|---|---|---|
| 8,333,372 | B2 * | 12/2012 | Awaya | B65H 37/04 270/58.07 |
| 8,774,702 | B2 * | 7/2014 | Sekigawa | B65H 29/6609 270/58.11 |
| 9,415,560 | B2 * | 8/2016 | Morinaga | B42C 13/00 |
| 2010/0308526 | A1 | 12/2010 | Awaya et al. | |
| 2013/0069298 | A1 | 3/2013 | Awaya et al. | |
| 2014/0030000 | A1 * | 1/2014 | Gamo | G03G 15/6582 399/408 |
| 2015/0037119 | A1 | 2/2015 | Tanaka et al. | |
| 2015/0076759 | A1 | 3/2015 | Kosuge et al. | |
| 2015/0091246 | A1 | 4/2015 | Yoshida et al. | |
| 2015/0093214 | A1 | 4/2015 | Takahashi et al. | |

* cited by examiner

BINDING DEVICE AND IMAGE FORMING APPARATUS INCLUDING THE SAME

CROSS-REFERENCE TO RELATED APPLICATIONS

The present application claims priority to and incorporates by reference the entire contents of Japanese Patent Application No. 2014-163277 filed in Japan on Aug. 11, 2014.

BACKGROUND OF THE INVENTION

1. Field of the Invention

The present invention relates generally to a binding device configured to perform a sheet-bundle binding process by bringing two rotary members, each including a serrated portion formed on an outer circumferential surface of the rotary member, into engagement with each other with a sheet bundle pinched therebetween, and an image forming apparatus such as a copier, a printer, a facsimile, or a multifunction circumferential having two or more of a copier function, a printer function, and a facsimile function including the binding device.

2. Description of the Related Art

A known type of binding devices mounted on an image forming apparatus such as a copier or a printer includes serrated portions and binds a sheet bundle made up of a plurality of sheets by pressing the serrated portions against the sheet bundle to form serrations in the sheet bundle in the thickness direction and bring the sheets into engagement with each other, thereby performing a binding process without using a metal staple. An example of such a binding device is disclosed in Japanese Patent No. 5253453.

More specifically, the binding device disclosed in Japanese Patent No. 5253453 includes two rotary members each including a serrated portion (i.e., having a serrating embossing profile) formed all around the outer circumferential surface of the rotary member. The binding device performs a binding process on a desired area of a sheet bundle (a bundle of a plurality of sheets) by rotating the two rotary members with the sheet bundle pinched therebetween to form serrations in the sheet bundle while moving the sheet bundle in a moving direction which lies along a rotating direction of the two rotary members.

Japanese Laid-open Patent Application No. 2013-180883 discloses a technique implemented as a binding device that performs a sheet-bundle binding process by bringing serrated portions, each formed on one of facing surfaces of two nonrotary members, into engagement with each other with a sheet bundle pinched therebetween. The binding device includes a sheet pressing member that holds the sheet bundle being bound to prevent the sheet bundle from becoming untidy in the binding process.

However, such a conventional binding device has a disadvantage that, when performing a sheet-bundle binding process by bringing two rotary members, each including a serrated portion formed on its outer circumferential surface, into engagement with each other with a sheet bundle pinched therebetween, the serrated portions pull the sheet bundle in a moving direction which lies along a direction in which the rotary members rotate, thereby distorting the sheet bundle. As a result, the sheets of the sheet bundle that have become untidy are bound unfavorably in terms of appearance.

As can be seen, there is a need for a binding device that, even when performing a sheet-bundle binding process by bringing two rotary members, each including a serrated portion formed on the outer circumferential surface of the rotary member, into engagement with each other with a sheet bundle pinched therebetween, is less likely to cause a problem that sheets of the sheet bundle become untidy and are bound unfavorably in terms of appearance, and an image forming apparatus including the binding device.

SUMMARY OF THE INVENTION

It is an object of the present invention to at least partially solve the problems in the conventional technology.

According to the present invention, there is provided a binding device for binding a bundle of sheets, the binding device comprising: a first rotary member including a serrated portion formed all around an outer circumferential surface of the first rotary member; a second rotary member including a serrated portion formed all around an outer circumferential surface of the second rotary member so as to be engaged with the serrated portion of the first rotary member at an engaging position, the second rotary member being configured to perform a binding process by rotating together with the first rotary member with a bundle of sheets pinched therebetween at the engaging position to thereby form serrations in a thickness direction in a desired area of the sheet bundle and bring the sheets into engagement with each other while relatively moving the sheet bundle in a predetermined moving direction; and a clamping unit configured to, when the binding process is performed on the sheet bundle pinched at the engaging position and being relatively moved in the moving direction, clamp the sheet bundle at a clamping position upstream of the engaging position so as to apply a predetermined pulling force acting in a direction opposite to the moving direction to the sheet bundle.

The present invention also provides an image forming apparatus comprising the above-described binding device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. Like numerals appearing in different drawings refer to identical or equivalent elements between the different drawings, and repeated description is simplified or omitted as appropriate.

First Embodiment

A first embodiment of the present invention is described in detail below with reference to FIGS. 1 to 6B.

An overall configuration and operations of an image forming apparatus are described below with reference to FIG. 1.

Figure 1:
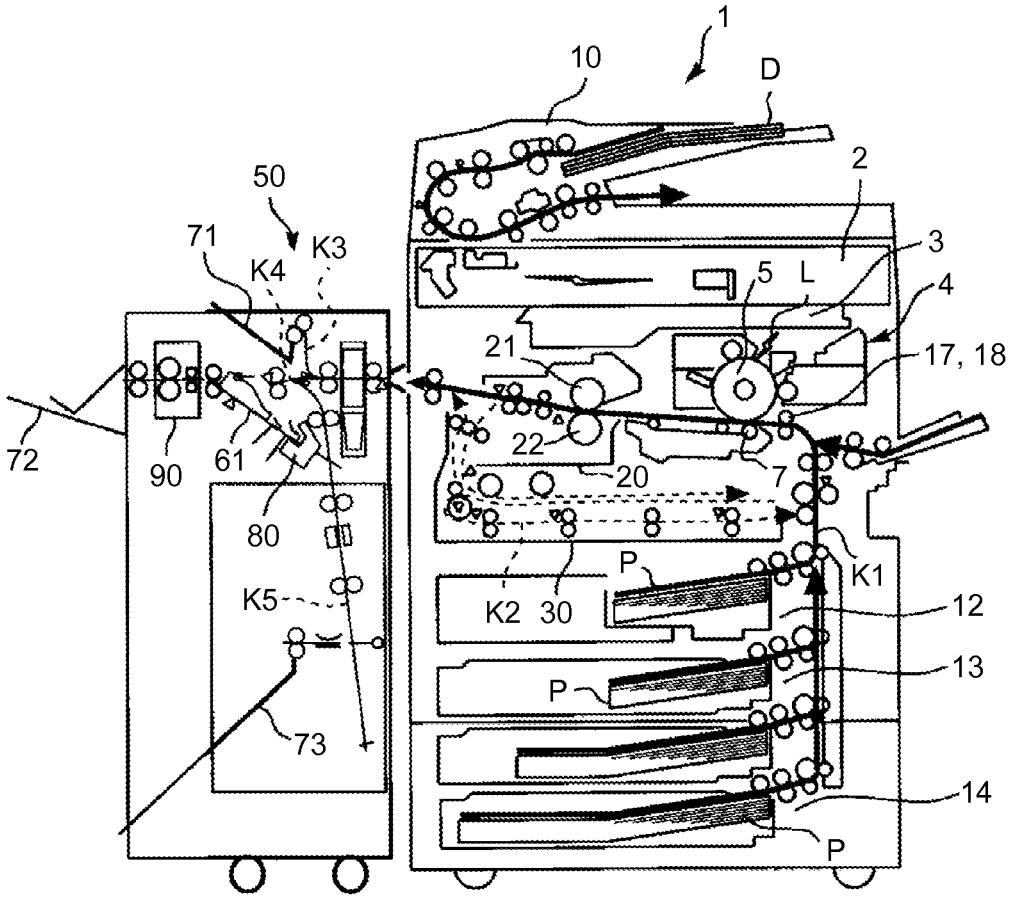
FIG. 1 is an overall configuration diagram of an image forming apparatus according to a first embodiment of the present invention.

Referring to FIG. 1, an image forming apparatus 1 implemented as a copier includes a document reading unit 2, an exposure unit 3, an image formation unit 4 including a photoconductor drum 5, a transfer unit (image forming unit) 7, a document conveying unit 10, sheet feeding units 12 to 14, registration rollers (timing rollers) 17 and 18, a fixing device 20, a fixing roller 21, a pressure applying roller 22, and a duplex-printing conveyance unit 30. The document reading unit 2 optically reads in image information representing an original document (hereinafter, "document") D. The exposure unit 3 irradiates the photoconductor drum 5 with exposure light L in accordance with the image information read-in by the document reading unit 2. The image formation unit 4 forms a toner image (image) on the photoconductor drum 5. The transfer unit 7 transfers the toner image formed on the photoconductor drum 5 onto a sheet P (of a print medium). The document conveying unit 10 conveys the document D placed thereon to the document reading unit 2. Each of the sheet feeding unit 12 to 14 holds the sheet(s) P such as transfer paper therein. The registration rollers 17 and 18 convey the sheet P toward the transfer unit 7. The fixing device 20 fixes a not-yet-fixed image on the sheet P. The fixing roller 21 and the pressure applying roller 22 are disposed in the fixing device 20. The duplex-printing conveyance unit 30 turns over the sheet P, an image has been formed on a front side of which, and conveys the turned-over sheet P toward the image forming unit 7.

A post-processing apparatus 50 performs a post-processing on the sheet P ejected from the image forming apparatus 1 and delivered into the post-processing unit 50. The post-processing apparatus 50 includes a stacker (internal tray) 61, trays (sheet output trays) 71 to 73, a binding device (first binding device) 80, and a binding device (third binding device) 90. The stacker 61 is disposed inside the post-processing apparatus 50. Each of the sheet output trays 71 to 73 is a tray on which the sheet(s) P (or a sheet bundle) having undergone the post-processing is to be ejected and stacked in a pile. The first binding device 80 is disposed inside the post-processing apparatus 50 to perform a binding process on a trailing end of a sheet bundle. The third binding device 90 is disposed inside the post-processing apparatus 50 to perform a binding process on a side portion of a sheet bundle. The post-processing apparatus 50 is detachably connected to the image forming apparatus 1.

How the image forming apparatus 1 performs normal image forming is described below with reference to FIG. 1.

The document D is conveyed by conveying rollers in the document conveying unit 10 from a document table in a direction indicated by an arrow in FIG. 1 to pass above the document reading unit 2. The document reading unit 2 optically reads in image information representing the document D passing above the document reading unit 2.

The image information optically read-in by the document reading unit 2 is converted into electric signals and transmitted to the exposure unit 3 (writing unit). The exposure unit 3 emits the exposure light L, which may be laser light for example, in accordance with the image information represented by the electric signals toward the photoconductor drum 5 of the image formation unit 4.

Meanwhile, the photoconductor drum 5 of the image formation unit 4 is rotating clockwise in FIG. 1. Through predetermined image forming processes (a charging process, an exposure process, and a developing process), an image (toner image) in accordance with the image information is formed on the photoconductor drum 5.

Thereafter, the transfer unit 7 which is the image forming unit transfers the image formed on the photoconductor drum 5 onto the sheet P conveyed by the registration rollers 17 and 18.

How the sheet P is conveyed to the transfer unit 7 (image forming unit) is described below.

One of the plurality of sheet feeding units 12, 13, and 14 included in the image forming apparatus 1 is automatically or manually selected. It is assumed in this description that the sheet feeding unit 12, which is the uppermost one, is selected, for example.

An uppermost one of the sheets P stored in the sheet feeding unit 12 is conveyed toward a conveyance path K1.

Thereafter, the sheet P is conveyed through the conveyance path K1 where a plurality of conveying rollers are arranged to the registration rollers 17 and 18. After reaching the registration rollers 17 and 18, the sheet P is conveyed toward the transfer unit 7 (image forming unit) with timing adjusted for registration with the image formed on the photoconductor drum 5.

The sheet P having undergone the above-described transfer process is further conveyed from the transfer unit 7 along a conveyance path to the fixing device 20. The sheet P conveyed to the fixing device 20 is delivered to between the fixing roller 21 and the pressure applying roller 22. Heat applied from the fixing roller 21 and a pressure applied from the rollers 21 and 22 fix the image onto the sheet P. The sheet P where the image is fixed is delivered out from between (i.e., a nip area) the fixing roller 21 and the pressure applying roller 22 and thereafter ejected from the image forming apparatus 1.

If the above-described "simplex printing mode" is selected, the sheet P of which the front side has undergone the above-described fixing process is ejected without any further process. However, if "duplex printing mode" where printing is to be performed on the both sides (the front side and the back side) of the sheet P is selected, the sheet P of which the front side has undergone the fixing process is led, rather than being ejected, to a duplex-printing conveyance path K2 where the conveying direction of the sheet P is reversed by the duplex-printing conveyance unit 30. Thereafter, the sheet P is conveyed toward the transfer unit 7 (image forming unit) again. At the transfer unit 7, an image is formed on the back side of the sheet P through the image forming processes similar to those described above. Thereafter, the sheet P undergoes the fixing process performed by the fixing device 20 and is conveyed along the conveyance path to be ejected from the image forming apparatus 1.

In the first embodiment, the post-processing apparatus 50 is connected to the image forming apparatus 1 so as to perform post-processing on the sheet P ejected and conveyed from the image forming apparatus 1 to the post-processing apparatus 50.

Referring to FIG. 1, the post-processing apparatus 50 according to the first embodiment is configured to convey the sheet P conveyed from the image forming apparatus 1 to any one of three conveyance paths (denoted by K3, K4, and K5), each being a conveyance path for one of different post-processing processes, so that one of the post-processing process is performed. The first conveyance path K3 is a conveyance path for ejecting the sheet P conveyed from the image forming apparatus 1 onto the first sheet output tray 71 without any post-processing. The second conveyance path K4 is a conveyance path for stacking, one sheet by one sheet, the sheets P conveyed from the image forming apparatus 1 onto the stacker 61 (internal tray) where any one of a sheet-trailing-end binding process by the first binding device 80 and a sheet-side-portion binding process by the third binding device 90 (binding device) is performed, and ejecting the processed sheets P (a sheet bundle PT) onto an external tray 72 (second sheet output tray) through a paper ejection port 50*b* using paper ejection rollers 60. The third conveyance path K5 is a conveyance path for performing, after switching back the conveying direction of the sheet P conveyed from the image forming apparatus 1 and temporarily conveyed to the second conveyance path K4, a saddle binding process by a second binding device 83 and/or a folding process using a sheet folding blade 84 and the like, and ejecting the processed sheet(s) P onto the third sheet output tray 73 (see also FIG. 2).

Switching among the three conveyance paths (K3 to K5) is performed by switching (pivoting) a bifurcating claw 81.

Figure 2:
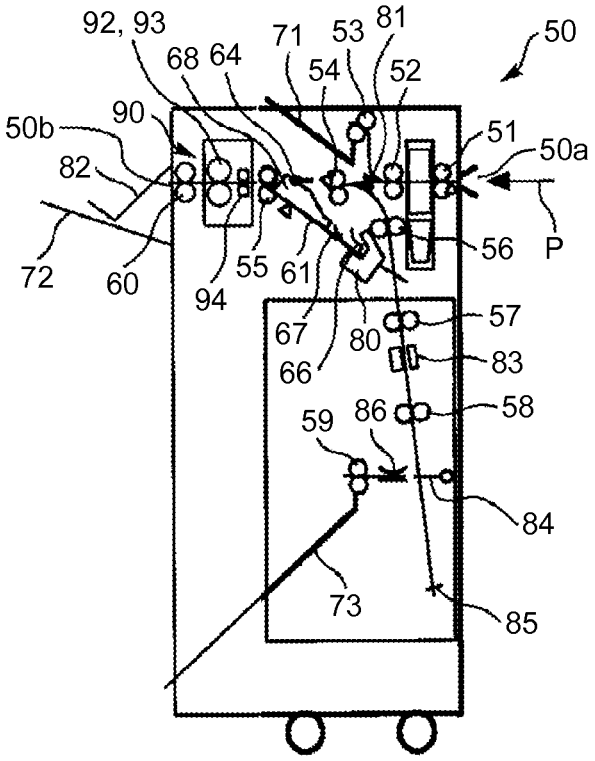
FIG. 2 is a schematic configuration diagram illustrating a post-processing apparatus.

More specifically, as shown in FIG. 2, first conveying rollers 51 and a paper sensor are arranged near an inlet port 50*a* of the post-processing apparatus 50. When detected by the paper sensor, the sheet P is conveyed into the post-processing apparatus 50 by the first conveying rollers 51 and second conveying rollers 52. The bifurcating claw 81 pivots so as to bring the sheet P to a desired one, which depends on a post-processing mode selected by a user in advance, of the conveyance paths K3 to K5.

If a no-post-processing mode is selected, the sheet P is conveyed to the first conveyance path K3 and ejected by third conveying rollers 53 onto the first sheet output tray 71.

If "sorting mode" is selected, the sheet P is conveyed to the second conveyance path K4 to be conveyed while being shifted (moved), for the each sheet P, a predetermined distance in a width direction (the direction perpendicular to the plane of FIG. 2) by fourth conveying rollers 54 configured to be movable in the width direction. The sheet P is further conveyed by fifth conveying rollers 55 through the third binding device 90 (two rotary members (92 and 93), and a clamping unit 94 are in a separated state). Thereafter, the sheet P is conveyed by the paper ejection rollers 60 to be stacked in the external tray 72 (second sheet output tray) to form a pile.

As shown in FIG. 2, a feeler 82 operable to pivot on a support shaft arranged at its upper end is arranged above the external tray 72. The external tray 72 is configured to be moved up and down by a moving mechanism (not shown). A sensor arranged near the support shaft of the feeler 82 detects a contact state of a center portion in the conveying direction of the sheets P stacked in the external tray 72 in a pile. The height of the pile of the sheets P in the external tray 72 can thus be detected based on an output of the sensor. The vertical position of the external tray 72 is to be adjusted depending on whether or not the number of the sheets P stacked on the external tray 72 has increased or decreased. When the vertical position of the external tray 72 has reached its lower limit, it is assumed that the number of the sheets P stacked on the external tray 72 has reached its upper limit (become full). In this case, the post-processing apparatus 50 transmits a stop signal to the image forming apparatus 1, thereby causing the image forming apparatus 1 to stop image forming.

If "trailing-end binding" is selected at "binding mode (stapling mode)", the sheet P conveyed to the second conveyance path K4 is conveyed by the fourth conveying rollers 54 without being shifted (moved) and stacked in the stacker 61 (internal tray) to form a pile. If a desired number of the sheets P (the sheet bundle PT) have been stacked on a stacking surface of the stacker 61, a tapping roller 64 arranged above the stacker 61 moves to a position where the tapping roller 64 contacts an uppermost one of the sheets P. The tapping roller 64 is driven to rotate counterclockwise in FIG. 2, thereby conveying (moving) the plurality of sheets P (the sheet bundle PT) toward a fence unit 66. As a result, trailing ends (trailing ends in the conveying direction) of the plurality of sheets P (the sheet bundle PT) are abutted against the fence unit 66, causing the plurality of sheets P to be aligned in the conveying direction.

Simultaneously, as shown in FIG. 2, jogger fences 68 arranged on opposite ends in the width direction of the stacker 61 move in the width direction so as to sandwich the plurality of sheets P stacked in the stacker 61, thereby aligning the plurality of sheets P in the width direction. The first binding device 80 performs the binding process on the trailing ends of the sheets P (the sheet bundle PT) aligned in both the conveying direction and the width direction.

Thereafter, the bound sheets P (the sheet bundle PT) are upwardly moved along a slope of the stacking surface 62 by a sheet discharging claw 67 which moves in a paper ejection direction. The bound sheets P (the sheet bundle PT) are further conveyed by the fifth conveying rollers 55 to pass through the third binding device 90 (the rotary members 92 and 93, and the clamping unit 94 are in the separated state) and, thereafter, conveyed by the paper ejection rollers 60 to be ejected onto the external tray 72.

Figure 6A:
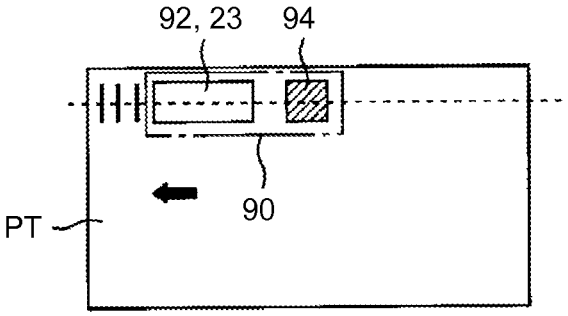
FIGS. 6A and 6B are top views, with FIG. 6A illustrating relative position between the two rotary members and a clamping unit, FIG. 6B illustrating relative position between the two rotary members and a conveying roller.

If "side-portion binding" is selected at the "binding mode (stapling mode)", the same processes as those in the "trailing-end binding" in which a desired number of the sheets P (the sheet bundle PT) are stacked on the stacking surface 62 of the stacker 61 and the sheet bundle PT is aligned by the fence unit 66 and the jogger fences 68 are performed. However, thereafter, without being bound by the first binding device 80, the sheet bundle PT is upwardly moved along the slope of the stacking surface 62 by the sheet discharging claw 67 which moves in the paper ejection direction. The sheet bundle PT is then conveyed by the fifth conveying rollers 55 to the third binding device 90. The third binding device 90, which is the binding device, performs the binding process on a desired area of a side portion (which is an end portion in the width direction perpendicular to the conveying direction) of the sheet bundle PT. An example of the position (the side portion) of the sheet bundle PT at which the sheet bundle PT is bound is illustrated in FIG. 6A.

Thereafter, the bound sheet bundle PT is conveyed by the paper ejection rollers 60 to be ejected onto the external tray 72.

The "side-portion binding" described above can be performed on the sheets P (the sheet bundle PT) of various sizes, from small size to large size.

If "folding mode" is selected, the sheet P is conveyed to the second conveyance path K4 where the conveying direction of the sheet P, which is pinched at its trailing end by the fourth conveying rollers 54, is switched back by reverse rotations of the fourth conveying rollers 54 to thereby be conveyed to the third conveyance path K5. The sheet P conveyed to the third conveyance path K5 is conveyed by sixth to eighth conveying rollers 56 to 58 to a position where the center portion of the sheet P faces the second binding device 83. After a desired number of the sheets P (the sheet bundle PT) have been stacked at the position, the second binding device 83 performs the binding process on the center portion of the sheet bundle. Thereafter, the bound plurality of sheets P (the sheet bundle PT) is conveyed by the seventh and eighth conveying rollers 57 and 58 to a position where the center portion of the sheets P (the sheet bundle PT) faces the sheet folding blade 84. At this position, the leading ends of the sheets P (the sheet bundle PT) are abutted against a stopper unit 85 which is configured to be moved in the conveying direction by a moving mechanism (not shown).

The sheet folding blade 84 moves to the left in FIG. 2 to fold the sheets P (the sheet bundle PT) at the center portion. The folded portion is pressed between sheet folding plates 86. The sheet bundle PT is folded in this manner. Thereafter, the folded sheets P (the sheet bundle PT) are conveyed by ninth conveying rollers 59 to be ejected onto the third sheet output tray 73.

A specific configuration and operations of the binding device 90 (third binding device) according to the first embodiment are described below.

As described earlier with reference to FIGS. 1 and 2 and other drawings, the post-processing apparatus 50 according to the first embodiment includes therein the binding device 90 for performing the binding process on a side portion of the sheet bundle PT. The binding device 90 (third binding device) differs from the first and second binding devices 80 and 83 in being configured to perform the binding process while conveying the sheet bundle PT.

Figure 3:
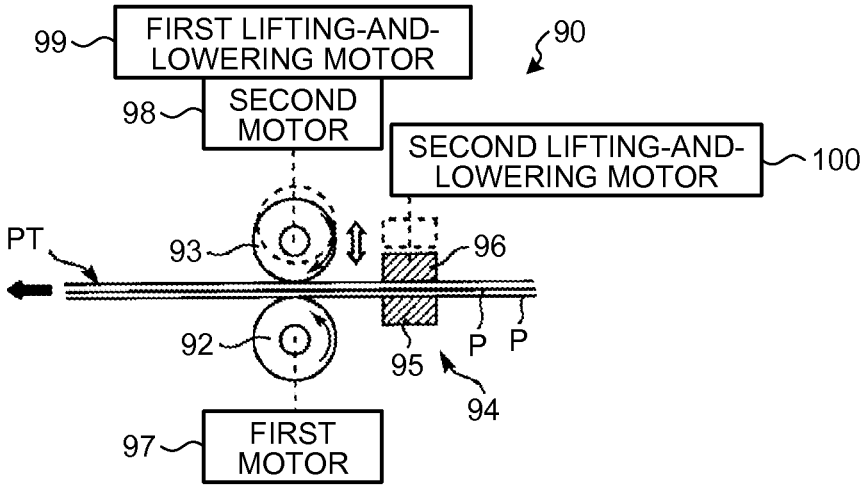
FIG. 3 is a schematic configuration diagram illustrating a binding device.
Figure 4:
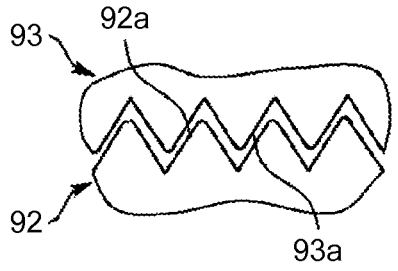
FIG. 4 is an enlarged diagram illustrating serrated portions of two rotary members in mutual engagement.

As shown in FIG. 3, the binding device 90 includes a binding device body, the clamping unit 94, a first motor 97, a second motor 98, a first lifting-and-lowering motor 99, and a second lifting-and-lowering motor 100. The binding device body is made up of the first rotary member 92 and the second rotary member 93. The clamping unit 94 is made up of a pair of nonrotary members (a first pressing member 95 and a second pressing member 96). The first motor 97 rotates the first rotary member 92 counterclockwise in FIG. 3. The second motor 98 rotates the second rotary member 93 clockwise in FIG. 3. The first lifting-and-lowering motor 99 moves the second rotary member 93 into contact with and away from the first rotary member 92. The second lifting-and-lowering motor 100 moves the second pressing member 96 into contact with and away from the first pressing member 95. Referring also to FIG. 4, the binding device body made up of the first and second rotary members 92 and 93 performs the binding process by pressing serrated portions 92*a* and 93*a* against the sheet bundle PT to form serrations in the sheet bundle PT in the thickness direction and bring the sheets P into mutual engagement.

More specifically, as shown in FIGS. 3 and 4, the first rotary member 92 and the second rotary member 93 are disposed substantially below and above each other. The serrated portion 92*a* is formed all around the outer circumferential surface of the first rotary member 92. The serrated portion 93*a* to be engaged with the serrated portion 92*a* of the first rotary member 92 is formed all around the outer circumferential surface of the second rotary member 93. The second rotary member 93 is configured to perform the binding process by rotating together with the first rotary member 92 with the sheet bundle PT pinched therebetween at an engaging position where the second rotary member 93 engages with the first rotary member 92 to thereby form serrations in the thickness direction in a desired area of the sheet bundle PT and bring the sheets P into engagement with each other while relatively moving the sheet bundle PT in a predetermined moving direction. The moving direction is the conveying direction indicated by the solid arrow in FIG. 3. Put another way, the first rotary member 92 and second rotary member 93 rotate, with the sheet bundle PT pinched therebetween, along the conveying direction to convey the sheet bundle PT in the conveying direction and also to perform the binding process on a side portion (an end portion in the width direction) of the sheet bundle PT.

As shown in FIG. 4, in the first embodiment, distal ends of each of the serrated portions 92*a* and 93*a* of the two rotary members (92 and 93) are rounded. This shape allows preventing a problem, which can occur during the binding process, that the sheet bundle PT pinched between the serrated portions 92*a* and 93*a* is sheared by the serrated portions 92*a* and 93*a*.

Referring to FIG. 3, the clamping unit 94 is configured to, when the binding process is performed on the sheet bundle PT pinched at the engaging position of the two rotary members (92 and 93) and relatively moved in the moving direction (conveying direction), clamp the sheet bundle PT at a position upstream of the engaging position so as to apply a predetermined pulling force acting in the direction opposite to the moving direction to the sheet bundle PT. More specifically, when the binding process is performed on the sheet bundle PT being conveyed in the conveying direction by the first rotary member 92 and second rotary member 93 that rotate, with the sheet bundle PT pinched therebetween, along the conveying direction, the sheet bundle PT is pulled by the clamping unit 94 in the direction opposite to the conveying direction at the position upstream of the binding position in the conveying direction. The clamping unit 94 is the pair of nonrotary members (the first pressing member 95 and the second pressing member 96) each including a flat portion for clamping the sheet bundle PT by making flat contact therewith.

In the first embodiment, the first rotary member 92, the second rotary member 93, and the clamping unit 94 are disposed at positions fixed relative to each other in the moving direction of the sheet bundle PT. The sheet bundle PT is conveyed in the moving direction which is the conveying direction.

The second rotary member 93 is configured to be relatively movable between a position (hereinafter, "separated position") separated from the first rotary member 92 and the engaging position. The clamping unit 94 is configured to be switchable between a state where the clamping unit 94 is clamping the sheet bundle PT and a state where the clamping unit 94 is not clamping the same. When the binding process is not to be performed on the sheet bundle PT at the engaging position of the two rotary members (92 and 93), the second rotary member 93 is separated from the first rotary member 92, and the clamping unit 94 is switched to the state where the clamping unit 94 does not clamp the sheet bundle PT.

This will be described in detail below. The second rotary member 93 is connected to a cam mechanism (not shown) and configured to be moved in the directions indicated by the hollow arrow in FIG. 3 when the first lifting-and-lowering motor 99 that drives the cam mechanism is driven. The second pressing member 96 is connected to a cam mechanism (not shown) and configured to be moved in the directions indicated by the hollow arrow in FIG. 3 when the second lifting-and-lowering motor 100 that drives the cam mechanism is driven.

More specifically, when the binding process is to be performed on the sheet bundle PT, the second rotary member 93 moves downward in FIG. 3 so as to engage the serrated portion 92*a* (sawtooth portion) of the first rotary member 92 with the serrated portion 93*a* (sawtooth portion) of the second rotary member 93 (this state is illustrated with solid line in FIG. 3). Substantially simultaneously therewith, the second pressing member 96 moves downward in FIG. 3 so as to clamp the sheet bundle PT between the first pressing member 95 and the second pressing member 96 (this state is illustrated with solid line in FIG. 3).

By contrast, when the binding process is not to be performed on the sheet bundle PT, the second rotary member 93 moves upward in FIG. 3 so as to separate the serrated portion 93*a* (sawtooth portion) of the second rotary member 93 from the serrated portion 92*a* (sawtooth portion) of the first rotary member 92. Substantially simultaneously therewith, the second pressing member 96 moves upward in FIG. 3 so as not to clamp the sheet bundle PT between the first pressing member 95 and the second pressing member 96.

How the binding device 90 (third binding device) operates during the binding process is more specifically described below.

First, the second rotary member 93 and the second pressing member 96 are respectively withdrawn to the separated position indicated by dashed lines in FIG. 3. When the sheet bundle PT has been conveyed by the fifth conveying rollers 55 located upstream of the binding device 90 to a position where a desired area (which is the area where the binding process is to be performed) of the sheet bundle PT is placed between the two rotary members (92 and 93), the second rotary member 93 moves to the engaging position indicated by the solid line in FIG. 3 and, simultaneously, the second pressing member 96 moves to a clamping position indicated by the solid line in FIG. 3. The first rotary member 92 and the second rotary member 93 are rotated counterclockwise and clockwise in FIG. 3 by the first motor 97 and the second motor 98, respectively, in a manner adjusted to a conveyance velocity of the sheet bundle PT conveyed by the fifth conveying rollers 55 (or the paper ejection rollers 60) to perform the binding process on a side portion of the sheet bundle PT. At this time, a force dragging the sheet bundle PT in the conveying direction (that is, a force pulling the sheet bundle PT in the conveying direction) is applied from the two rotary members (92 and 93) to the sheet bundle PT. However, because the clamping unit 94 pulls the sheet bundle PT so as to cancel the dragging force, the binding process can be completed with the conveying velocity of the sheet bundle PT maintained substantially constant. At this time, the sheet bundle PT appears to be conveyed in the direction indicated by the solid arrow in FIG. 3 as if the sheet bundle PT slips through the clamping position of the clamping unit 94. After the binding process is completed, the second rotary member 93 and the second pressing member 96 are respectively withdrawn to the separated position indicated by the dashed lines in FIG. 3.

Although the two rotary members (92 and 93) are separately driven to rotate by the independent motors 97 and 98 in the first embodiment, alternatively, a configuration in which the two rotary members (92 and 93) are driven to rotate by a single motor via a gear train or the like may be employed.

The configuration described above allows preventing the problem that, when the binding process is performed on the sheet bundle PT by bringing the two rotary members (92 and 93) with the sheet bundle PT pinched therebetween into mutual engagement, the sheet bundle PT is pulled by the serrated portions 92*a* and 93*a* in the moving direction (conveying direction) which lies along the rotating direction of the rotary members 92 and 93, resulting in distortion of the sheet bundle PT, whereby the sheets P of the sheet bundle PT become untidy and are bound unfavorably in terms of appearance.

Figure 5A:
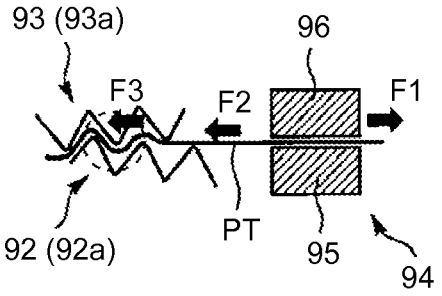
FIGS. 5A and 5B are schematic diagrams, with FIG. 5A illustrating forces applied to a sheet bundle in a conveying direction during a binding process, FIG. 5B illustrating the sheet bundle having not yet undergone the binding process and that undergone the same.
Figure 5B:
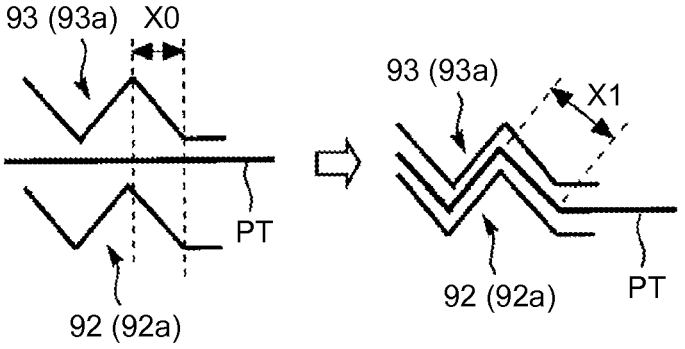

More specifically, with reference to FIG. 5B, if the sheet bundle PT is bound without being clamped by the clamping unit 94, the sheet bundle PT is undesirably dragged into the rotary members 92 and 93 in the conveying direction over the length approximately expressed by (X1-X0), causing the sheet bundle PT to be distorted. By contrast, in the first embodiment, because the clamping unit 94 clamps the sheet bundle PT to pull the sheet bundle PT in the direction opposite to the conveying direction, the distance over which the sheet bundle PT is dragged in the conveying direction can be reliably reduced. Because the sheet bundle PT is less likely to be distorted, the sheets P can be bound favorably in terms of appearance.

Meanwhile, with reference to FIG. 5A, the first embodiment is configured so as to satisfy the following relationship:

$$F3<F1<F2$$

where F1 is the predetermined pulling force acting in the direction opposite to the moving direction (conveying direction) applied by the clamping unit 94, F2 is the moving force by which the sheet bundle PT is moved in the moving direction (put another way, the conveying force by which the sheet bundle PT is conveyed by the fifth conveying rollers 55), and F3 is the force (dragging force) by which the sheet bundle PT is pulled by the serrated portions 92*a* and 93*a* in the moving direction when the sheet bundle PT is pinched at the engaging position of the two rotary members (92 and 93).

This configuration allows reliably reducing the distance over which the sheet bundle PT is dragged in the conveying direction without hindering conveyance of the sheet bundle PT.

In the first embodiment, as illustrated in FIG. 6A, the clamping position where the clamping unit 94 clamps the sheet bundle PT is near the engaging position of the two rotary members (92 and 93) such that the clamping position and the engaging position are on a virtual straight line (indicated by the dashed line in FIG. 6A) lying along the moving direction (conveying direction).

This layout makes the pulling force F1, which is described above with reference to FIG. 5A and applied by the clamping unit 94, and the dragging force F3 applied by the two rotary members (92 and 93) act on the same straight line, thereby efficiently canceling the dragging force F3 without producing a moment of the dragging force F3 and the pulling force F1.

Figure 6B:
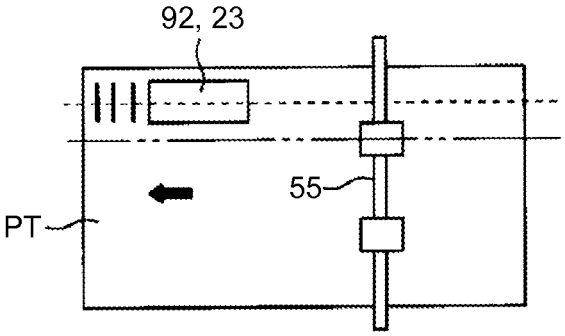

More specifically, if a layout where the clamping position and the engaging position are not on the same virtual straight line lying along the moving direction (conveying direction) is employed, a moment of the dragging force F3 and the pulling force F1 is undesirably produced, which prevents efficient cancellation of the dragging force F3. For example, if the fifth conveying rollers 55 are configured to be brought close to the engaging position as illustrated in FIG. 6B to function also as a clamping unit, a moment of the pulling force F1 applied from roller portions of the fifth conveying rollers 55 and the dragging force F3 applied by the two rotary members (92 and 93) is undesirably produced. This moment can form wrinkles in a portion of the sheet bundle PT between the roller portions and the rotary members 92 and 93.

In the first embodiment, whole or at least portions (flat portions), at which the clamping unit 94 contacts the sheet bundle PT, of the clamping unit 94 (the first pressing member 95 and the second pressing member 96) are made of material highly resistant to friction.

When the clamping unit 94 is made as such, because the pulling force F1 applied by the clamping unit 94 is set to a certain value or higher, the distance over which the sheet bundle PT is dragged in the conveying direction can be reduced.

Figure 7:
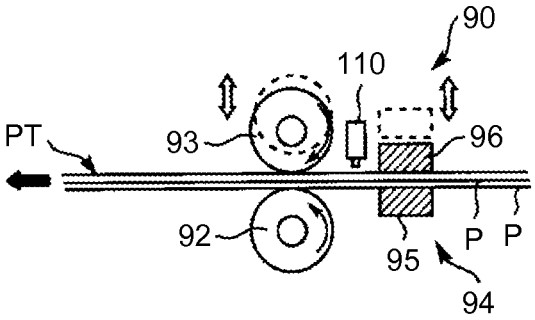
FIG. 7 is a schematic diagram illustrating a modification of the binding device.

The first embodiment may be modified as illustrated in FIG. 7 to further include a moistening unit 110 that performs a moistening process on the desired area (the portion where the binding process is to be performed) of the sheet bundle PT before the sheet bundle reaches the engaging position of the two rotary members (92 and 93). More specifically, the moistening unit 110 arranged at a position upstream of the engaging position sprays water onto the desired area of the sheet bundle PT.

The moistening process performed by the moistening unit 110 onto the portion of the sheet bundle PT where the binding process is to be performed loosens fibers of the sheets P. As a result, the distance over which the sheet bundle PT is dragged in the conveying direction can be reduced even when the dragging force F3 is applied from the two rotary members (92 and 93) to the sheet bundle PT in the binding process. Hence, even if the pulling force F1 applied by the clamping unit 94 is not set to a considerably high value, undesirable distortion of the sheet bundle PT can be prevented or at least reduced.

In the modification illustrated in FIG. 7, the moistening unit 110 and the clamping unit 94 may be formed in one piece.

As described above, in the first embodiment, even if the binding process is performed on the sheet bundle PT by bringing the two rotary members (92 and 93), each including the serrated portion 92*a*, 93*a* formed on the outer circumferential surface of the rotary member, into engagement with each other with the sheet bundle PT pinched therebetween, the clamping unit 94 clamps the sheet bundle PT at the position upstream in the conveying direction of the engaging position so as to apply the predetermined pulling force F1 acting in the direction opposite to the conveying direction to the sheet bundle PT when the binding process is performed on the sheet bundle PT moved in the conveying direction as being pinched at the engaging position of the two rotary members (92 and 93). Accordingly, the problem that the sheets P of the sheet bundle PT become untidy and are bound unfavorably in terms of appearance is less likely to occur.

Second Embodiment

A second embodiment of the present invention is described in detail below with reference to FIGS. 8A and 8B.

Figure 8A:
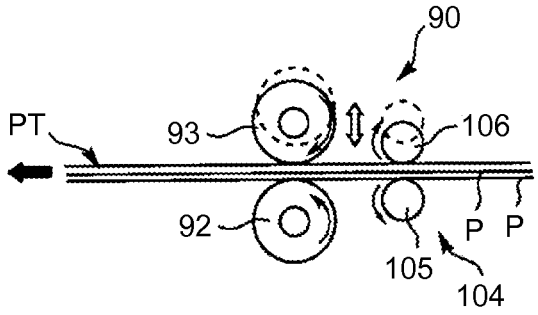
FIGS. 8A and 8B are schematic diagrams each illustrating a binding device according to a second embodiment of the present invention.
Figure 8B:
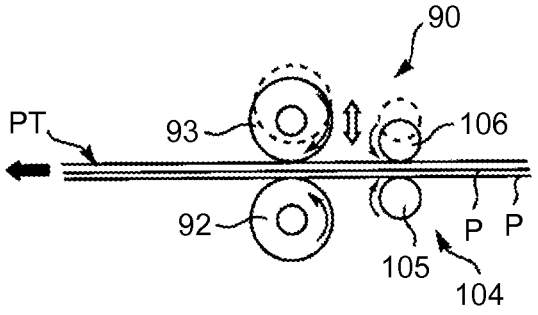

FIGS. 8A and 8B are schematic diagrams each illustrating the binding device 90 according to the second embodiment and corresponding to FIG. 3 of the first embodiment described above. The binding device 90 according to the second embodiment uses a pair of rotary members 105 and 106 as a clamping unit 104, in contrast to the binding device 90 according to the first embodiment that uses the pair of nonrotary members 95 and 96 as the clamping unit 94.

The binding device 90 according to the second embodiment includes, as does the binding device 90 according to the first embodiment, the binding device body made up of the first rotary member 92 and the second rotary member 93 and the like, and a clamping unit.

As illustrated in FIGS. 8A and 8B, in contrast the binding device 90 according to the first embodiment, the binding device 90 according to the second embodiment employs the pair of rotary members (the first roller member 105 and the second roller member 106) as the clamping unit 104.

More specifically, with reference to FIG. 8A, the two roller members (105 and 106) serving as the clamping unit 104 are configured to rotate, with the sheet bundle PT pinched therebetween, in opposite directions which are along the conveying direction (moving direction) of the sheet bundle PT. More specifically, as indicated by arrows in FIG. 8A, the two roller members (105 and 106) rotate in the same directions as the two rotary members (92 and 93), respectively, in the binding process.

As in the case of the second pressing member 96 according to the first embodiment, the second roller member 106 is configured to be movable up and down and withdrawn to a separated position separated from the first roller member 105 when the binding process is not performed.

Even if the clamping unit 104 is made up of the pair of rotary members as described above, the clamping unit 104 can apply the pulling force F1 to the sheet bundle PT being bound so as to cancel the dragging force F3 applied from the two rotary members (92 and 93) as in the first embodiment. Accordingly, because the sheet bundle PT is less likely to be distorted, the sheets P can be bound favorably in terms of appearance.

Note that in the binding device 90 illustrated in FIG. 8A, because the two roller members (105 and 106) rotate in the direction along the conveying direction of the sheet bundle PT, the two roller members (105 and 106) apply the pulling force F1 while assisting conveyance of the sheet bundle PT. Accordingly, because fine adjustment of the pulling force F1 can be made only by adjusting the number of revolutions (linear velocity) of the two roller members (105 and 106), the binding process can be performed more accurately.

The binding device 90 may alternatively be configured such that, as illustrated in FIG. 8B, the two roller members (105 and 106) serving as the clamping unit 104 rotate, with the sheet bundle PT pinched therebetween, in opposite directions which are against the conveying direction (the moving direction) of the sheet bundle PT. More specifically, in contrast to the binding device 90 illustrated in FIG. 8A, in the binding device 90 illustrated in FIG. 8B, the two roller members (105 and 106) rotate in the directions opposite to the directions in which the two rotary members (92 and 93) rotate, respectively, in the binding process.

When configured as such, the two roller members (105 and 106) rotate against the conveying direction of the sheet bundle PT and apply a moving force acting against the conveying direction to the sheet bundle PT. Accordingly, the two roller members (105 and 106) can apply the pulling force F1 (which includes the moving force acting in the opposite direction), which is larger than that in FIG. 8A. Hence, this configuration is effective for a situation where the dragging force F3 applied by the two rotary members (92 and 93) in the binding process can be large.

As described above, in the second embodiment, as in the first embodiment, even if the binding process is performed on the sheet bundle PT by bringing the two rotary members (92 and 93), each including the serrated portion 92*a*, 93*a* formed on the outer circumferential surface of the rotary member, into engagement with each other with the sheet bundle PT pinched therebetween, the clamping unit 94 clamps the sheet bundle PT at the position upstream in the conveying direction of the engaging position so as to apply the predetermined pulling force F1 acting in the direction opposite to the conveying direction to the sheet bundle PT when the binding process is performed on the sheet bundle PT moved in the conveying direction as being pinched at the engaging position of the two rotary members (92 and 93). Accordingly, the problem that the sheets P of the sheet bundle PT become untidy and are bound unfavorably in terms of appearance is less likely to occur.

In each of the first and second embodiments, each aspect of the present invention is applied to the binding device 90 mounted on the post-processing apparatus 50 of the monochrome image forming apparatus 1. However, possible applications are not limited thereto, but include binding devices mounted on a post-processing apparatus of a color image forming apparatus.

In each of the first and second embodiments, each aspect of the invention is applied to the binding device 90 mounted on the post-processing apparatus 50 of the electrophotographic image forming apparatus 1. However, possible applications are not limited thereto, but include binding devices mounted on a post-processing apparatus of an image forming apparatus of another image forming scheme. Examples of such an image forming apparatus include inkjet image forming apparatuses and mimeograph apparatuses.

Each aspect of the invention is applicable not only to the binding device 90 mounted on the post-processing apparatus 50 but also to independent binding devices. An independent binding device may include, for example, a sheet feeding cassette attached to the inlet port 50*a* and a control panel from which a user can enter a processing mode and the like.

These applications can provide an advantage similar to that of each of the first and second embodiments as well.

In each of the first and second embodiments, another post-processing apparatus (e.g., a device that z-folds the sheet(s) P) may be interposed between the image forming apparatus 1 and the post-processing apparatus 50.

In each of the first and second embodiments, each aspect of the invention is applied to the post-processing apparatus 50 capable of the binding process, the sorting process, and the folding process. However, possible applications are not limited thereto, but include binding devices further capable of a perforating process (punching process), binding devices capable of only the binding process among the above-described plurality of processes, and binding devices capable of anther combination of the processes.

The structures of the plurality of paths K3 to K5 in the post-processing apparatus 50 are not limited to those of the first and second embodiments, and may be of other various structures.

In each of the first and second embodiments, each aspect of the invention is applied to the binding device 90 (third binding device) that performs the binding process by moving the sheet bundle PT in the conveying direction relative to the two rotary members (92 and 93) and the clamping unit 94 (104) rather than moving the members 92 and 93 and the unit 94 (104). However, possible applications include binding devices where the two rotary members (92 and 93) and the clamping unit 94 (104) are configured to be movable in the moving direction and the binding process is performed on the sheet bundle PT by moving the members 92 and 93 and the unit 94 (104) rather than moving the sheet bundle PT. Examples of such a binding device include the binding device disclosed in Japanese Laid-open Patent Application No. 5253453, the first binding device 80, and the second binding device 83. When an aspect of the invention is applied to such a binding device, the binding device is preferably configured as follows. If the clamping unit 104 is made up of the pair of rotary members 105 and 106 and rotates in the same direction as the two rotary members (92 and 93) as illustrated in FIG. 8A, the clamping unit 104 rotates to move at the same velocity as the two rotary members (92 and 93) in synchronization therewith so that the distance between the engaging position and the clamping position in the moving direction is maintained constant. If the binding device is configured otherwise (such that, for example, the clamping unit is made up of a pair of nonrotary members), it is preferable that the clamping unit is fixed in the moving direction only during the binding process so that a pulling force is applied to a sheet bundle in the direction opposite to the moving direction.

The binding device configured described above can provide an advantage similar to that of each of the first and second embodiments. It should be noted that the advantage provided by an aspect of the invention is greater when applied to the binding device configured to perform the binding process by moving a sheet bundle rather than by moving the two rotary members and the clamping member than when applied to a binding device configured to perform the binding process by moving the two rotary members and the clamping member rather than by moving a sheet bundle. This is because the dragging force applied to the sheet bundle from the two rotary members is greater in the former binding device than in the latter.

An aspect of the present invention allows providing a binding device that, even when performing a sheet-bundle binding process by bringing two rotary members, each including a serrated portion formed on its outer circumferential surface, into engagement with each other with a sheet bundle pinched therebetween, is less likely to cause a problem that sheets of the sheet bundle become untidy and are bound unfavorably in terms of appearance, and an image forming apparatus including the binding device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A binding device for binding a sheet bundle, the binding device comprising:

a first rotary member including a first serrated portion formed all around an outer circumferential surface of the first rotary member;

a second rotary member including a second serrated portion formed all around an outer circumferential surface of the second rotary member so as to be engaged with the first serrated portion of the first rotary member at an engaging position, the second rotary member being configured to perform a binding process by rotating together with the first rotary member with the sheet bundle pinched therebetween at the engaging position to thereby form serrations in a thickness direction in a desired area of the sheet bundle and bring sheets in the sheet bundle into engagement with each other while relatively moving the sheet bundle in a moving direction; and a clamping unit configured to, when the binding process is performed on the sheet bundle pinched at the engaging position and being relatively moved in the moving direction, remain upstream in a sheet conveying direction from the first rotary member and the second rotary member in the sheet bundle conveying direction and clamp the sheet bundle at a clamping position upstream of the engaging position so as to apply a pulling force acting in a direction opposite to the moving direction to the sheet bundle.

2. The binding device according to claim 1, wherein the clamping position at which the clamping unit clamps the sheet bundle is located near the engaging position such that the clamping position and the engaging position are on a virtual straight line lying along the moving direction.

3. The binding device according to claim 1, wherein the clamping unit is made up of a pair of nonrotary members each including a flat portion for clamping the sheet bundle by making flat contact with the sheet bundle.

4. The binding device according to claim 1, wherein the clamping unit is made up of a pair of rotary members configured to rotate, with the sheet bundle pinched therebetween, in opposite directions, the opposite directions being either directions along the moving direction or directions against the moving direction.

5. The binding device according to claim 1, wherein whole or at least a portion of the clamping unit, the clamping unit making contact with the sheet bundle at the portion, is made of material resistant to friction.

6. The binding device according to claim 1, further comprising a moistening unit configured to perform a moistening process on the desired area of the sheet bundle before the sheet bundle reaches the engaging position.

7. The binding device according to claim 1, wherein the first rotary member, the second rotary member, and the clamping unit are disposed at positions fixed relative to each other in the moving direction, and the sheet bundle is conveyed in the moving direction.

8. The binding device according to claim 1, wherein the second rotary member is configured to be relatively movable between a position separated from the first rotary member and the engaging position, the clamping unit is configured to be switchable between a state where the clamping unit is clamping the sheet bundle and a state where the clamping unit is not clamping the sheet bundle, and when the binding process is not to be performed on the sheet bundle at the engaging position, the second rotary member is separated from the first rotary member and the clamping unit is switched to the state where the clamping unit is not clamping the sheet bundle.

9. An image forming apparatus comprising the binding device according to claim 1.

10. A binding device for binding a sheet bundle, the binding device comprising:

a first rotary member including a first serrated portion formed all around an outer circumferential surface of the first rotary member;

a second rotary member including a second serrated portion formed all around an outer circumferential surface of the second rotary member so as to be engaged with the first serrated portion of the first rotary member at an engaging position, the second rotary member being configured to perform a binding process by rotating together with the first rotary member with a sheet bundle pinched therebetween at the engaging position to thereby form serrations in a thickness direction in a desired area of the sheet bundle and bring sheets in the sheet bundle into engagement with each other while relatively moving the sheet bundle in a moving direction; and a clamping unit configured to, when the binding process is performed on the sheet bundle pinched at the engaging position and being relatively moved in the moving direction, clamp the sheet bundle at a clamping position upstream of the engaging position so as to apply a pulling force acting in a direction opposite to the moving direction to the sheet bundle, wherein the following relationship holds, $$F3<F1<F2$$

where F1 is the pulling force, F2 is a moving force by which the sheet bundle is moved in the moving direction, and F3 is a dragging force by which the sheet bundle is pulled by the first serrated portion and the second serrated portion in the moving direction when the sheet bundle is pinched at the engaging position.

11. An image forming apparatus comprising the binding device according to claim 10.

12. The binding device according to claim 10, wherein the clamping position at which the clamping unit clamps the sheet bundle is located near the engaging position such that the clamping position and the engaging position are on a virtual straight line lying along the moving direction.

13. The binding device according to claim 10, wherein the clamping unit is made up of a pair of nonrotary members each including a flat portion for clamping the sheet bundle by making flat contact with the sheet bundle.

14. The binding device according to claim 10, wherein the clamping unit is made up of a pair of rotary members configured to rotate, with the sheet bundle pinched therebetween, in opposite directions, the opposite directions being either directions along the moving direction or directions against the moving direction.

15. The binding device according to claim 10, further comprising a moistening unit configured to perform a moistening process on the desired area of the sheet bundle before the sheet bundle reaches the engaging position.

16. The binding device according to claim 10, wherein the first rotary member, the second rotary member, and the clamping unit are disposed at positions fixed relative to each other in the moving direction, and the sheet bundle is conveyed in the moving direction.

17. The binding device according to claim 10, wherein the second rotary member is configured to be relatively movable between a position separated from the first rotary member and the engaging position, the clamping unit is configured to be switchable between a state where the clamping unit is clamping the sheet bundle and a state where the clamping unit is not clamping the sheet bundle, and when the binding process is not to be performed on the sheet bundle at the engaging position, the second rotary member is separated from the first rotary member and the clamping unit is switched to the state where the clamping unit is not clamping the sheet bundle.

* * * * *